United States Patent [19]

Dubach

[11] Patent Number: 4,949,883

[45] Date of Patent: Aug. 21, 1990

[54] ONE-PIECE PLASTIC CLOSURE WITH A HINGE

[75] Inventor: Werner F. Dubach, Hubrain, Switzerland

[73] Assignee: Alfatechnic AG, Switzerland

[21] Appl. No.: 301,813

[22] Filed: Jan. 25, 1989

[30] Foreign Application Priority Data

Jan. 26, 1988 [CH] Switzerland ..... 260/88

[51] Int. Cl.[5] ..... B65D 35/44

[52] U.S. Cl. ..... 222/556; 222/92

[58] Field of Search ..... 222/92, 107, 212, 517, 222/543, 545, 556; 215/232

[56] References Cited

U.S. PATENT DOCUMENTS

| | | | |
|---|---|---|---|
| 2,778,533 | 1/1957 | Savary | 222/92 |
| 3,285,477 | 11/1966 | Marona et al. | 222/213 |
| 3,297,211 | 1/1967 | Unger | 222/545 X |
| 4,087,028 | 5/1978 | Lang | 222/556 |
| 4,377,247 | 3/1983 | Hazard et al. | 222/517 |
| 4,815,616 | 3/1989 | Silvenis | 215/232 |

FOREIGN PATENT DOCUMENTS

| | | | |
|---|---|---|---|
| 0011822 | 6/1980 | European Pat. Off. . | |
| 2930529 | 6/1981 | Fed. Rep. of Germany . | |
| 1213539 | 4/1960 | France | 222/543 |
| 892347 | 1/1982 | France . | |

*Primary Examiner*—Michael S. Huppert
*Attorney, Agent, or Firm*—Thomas W. Speckman; Douglas H. Pauley

[57] ABSTRACT

This invention relates to a one-piece closure which has a lower part and a cap connected with a hinge. The side walls of the lower part are inclined from the cover surface to the exterior. A discharge spout penetrates the cover surface. The discharge spout is inclined and parallel to a side wall part in the area of the hinge. The specific geometry of the closure makes it possible to inject into a mold a one-piece hinge closure, with walls inclined outwardly, without using a slide unit. This invention also makes it possible to construct the lower part of the closure as a tube head.

5 Claims, 3 Drawing Sheets

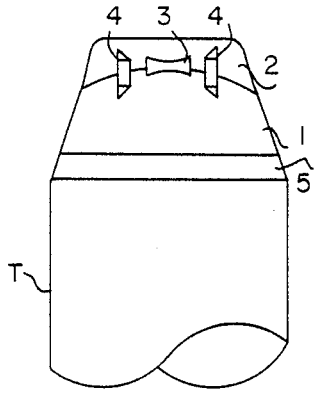
FIG. 1
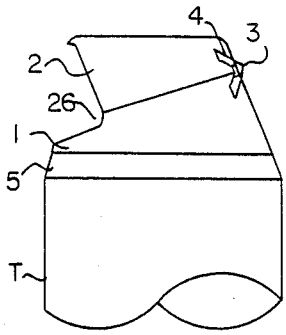
FIG. 2
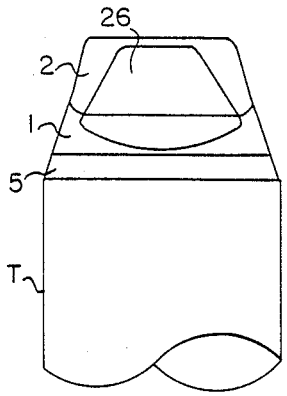
FIG. 3
FIG. 4
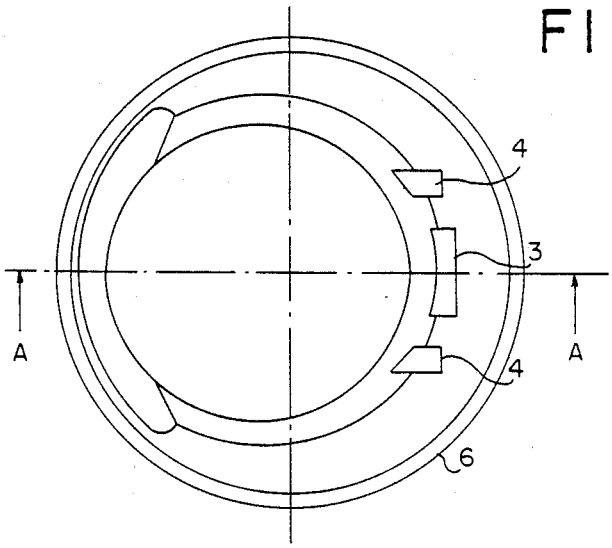

ONE-PIECE PLASTIC CLOSURE WITH A HINGE

BACKGROUND OF THE INVENTION

1. Field of the Invention

This invention relates to a one-piece plastic closure for containers. The closure has a hinge, a lower part having side walls and a sealing cover surface with a discharge spout positioned therein, and a cap which is hingedly connected with the lower part. The cap is used to seal the discharge spout.

2.Description of the Prior Art

In a known one-piece plastic closure with a hinge, both the side walls of the cap and the side walls of the lower part are perpendicular to the cover surface and to the base of the lower part. Only under such consitions has it been possible to produce a plastic closure of the type described with a plastic injection mold, without the use of a slide unit. It is now an object of this invention to provide a plastic closure of the type described above, having side walls proceeding outwardly and inclined from the cover surface, which can be manufactured in a plastic injection mold without requiring use of a slide unit.

Summary of the Invention

A closure having a side wall part, in which the hinge is positioned, is inclined toward the base surface of the lower part. The discharge spout penetrates the covering surface and is parallel to the side wall part. This invention makes it possible to manufacture a tube head in a single piece with the closure so that the entire part can be merged directly with a tube casing, particularly a tube casing of a plastic laminate.

It is known that a tube exists which has a cylindrical casing that is merged with a tube head. The tube head has a discharge spout adjoining one shoulder part, the external diameter of which corresponds to the internal diameter of the tube casing. The tube casing is merged onto a collar of the tube head. Known closures for tubes were previously placed on the discharge spout of the tube head. Such tube heads, on the discharge spout, were provided with an external screw thread.

If the tube is of aluminum, then such approach is sensible. Also, such an approach does not pose substantial problems for a manufacturer because the cylindrical lower part of the hinge closure can be removed from the injection mold without complications.

BRIEF DESCRIPTION OF THE DRAWINGS

This invention is illustrated in one preferred embodiment which is described in detail by the following drawings wherein:

FIGS. 1–3 show a back, side and front view, respectively, of the closure in a closed position and merged onto a tube, according to one embodiment of this invention;

FIG. 4 shows an enlarged top view of the closure as shown in FIGS. 1–3;

DESCRIPTION OF THE PREFERRED EMBODIMENTS

Figure 5:
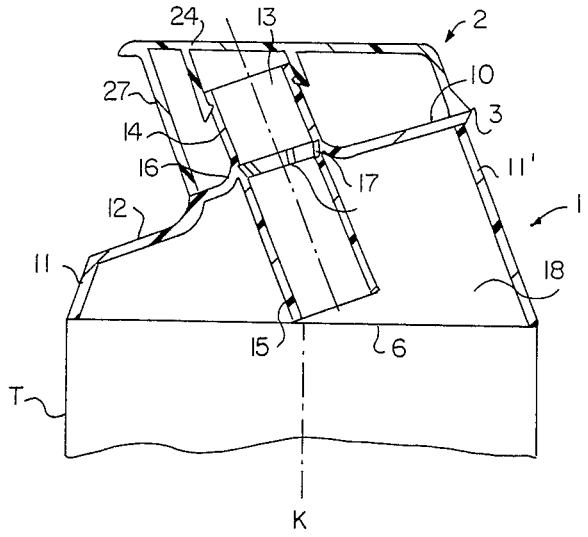
FIG. 5 shows a vertical section through the closed closure along the line A—A as shown in FIG. 4.

The general construction of the plastic closure in accordance with this invention is known. Such closures are attached to many bottles. The closure of this invention has a lower part (1) which can be placed on a container neck with which a cap (2) is hingedly connected. In one embodiment according to this invention, the lower part (1) and the cap (2) are connected with one another with a film hinge (3) and in another embodiment are connected with one another with one or several spring elements. In the embodiment of this invention shown in FIGS. 1–4, two tension bands (4) are positioned on both sides of the film hinge (3), parallel to one another and are provided as spring elements. The tension bands (4) are displaced relative to the film hinge (3) which is positioned to the center of the closure, and such arrangement provides a snapping effect of the closure as shown in FIG. 4.

The tube casing, which is only partially shown, is designated by (T) and consists of a plastic laminate foil. The otherwise normal tube head is lacking since the closure lower part assumes such function. The outermost edge of the closure lower part (1) is tapered by approximately the thickness of the plastic laminate foil so that the area of overlapping (5), in which the contour of the foil merges with the contour of the lower part to make the merge, is scarcely visible.

To illustrate the relatively complex geometry of the closure, particular reference is made to FIG. 5. This involves a vertical section through line A—A of the closure as shown in FIG. 4.

The lower part (1) has th shape of a truncated cone which is formed by a section of a straight circular cone. The cone axis (K) is normal to the base surface (6) which is circular. The cover surface (10) is inclined toward the cone axis (K). The inclination of the cover surface (10) is selected such that the cover surface (10) is perpendicular to the side wall part (11') in the area of the hinge (3). The cap (2) does not completely cover the cover surface (10) of the lower part (1). This portion (12) of the cover surface (10), not covered, is slightly offset in parallel and in a downward direction relative to the cover surface (10). The lower edge of the circumferential side wall (11) has a wall thickness which is reduced by the foil thickness of the tube casing (T). A portion of the cover surface (10) which is covered by the cap (2) is penetrated by a discharge spout (13). The discharge spout is designated in its entirety by (13). The spout part (14) of the discharge spout (13) positioned above the cover surface (10) has a greater diameter than the spout part (15) of the discharge spout (13) positioned below the cover surface (10). In the transition area (16) of both spout parts (14, 15), openings (17) are positioned to produce a connection between the discharge spout (13) and the space (18) below the cover surface (10). Such arrangement allows mixing of a material which is located in the space (18) into the strand of the second material which arises from the tube casing (T).

In order to facilitate opeining of the closure, a gripping recess (26) is provided in the area lying opposite the hinge (3). This gripping recess (26) is shaped in such a way that the cap (2), on the side placed against the hinge (3), has a side wall part (27) parallel to the wall part (11') of the lower part (1) in the area of the hinge (3).

For use of such plastic closures on containers which contain food materials or cosmetics, it is desirable to make the closure tamper proof to guarantee the contents of the container are intact. An element which assures intactness is achieved with the closure according to this invention. In general, such element is injected in the lower part (1), with predetermined breaking points. Upon a closig for a first time, such element engages with a form-locking and/or force-locking peice on the cap (2) of the closure. Thus the closure can first be opened through destruction of the predetermined breaking points.

Figure 6:
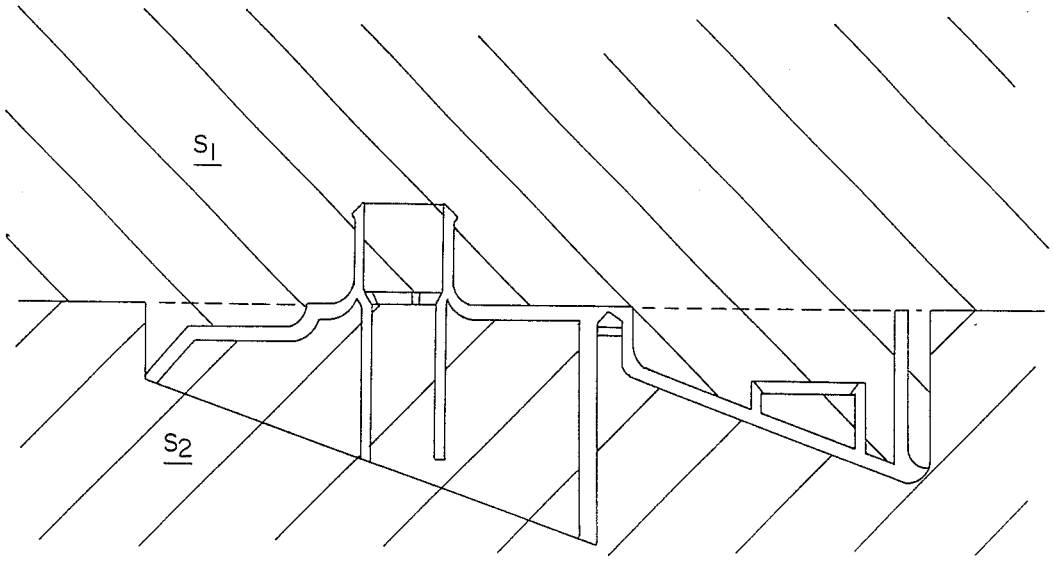
FIG. 6 shows a vertical section through the closure in a manufacturing position, with the injection molding indicated.

When the closure is viewed in an assembled position, it is not immediately obvious how the closure can be manufactured in an injection mold having no slide unit. Such injection molding without a slide unit would not be possible if the closure is injected in an assembled position in the mold. However, an injection molding without a slide unit can be accomplished if the closure is injected in an inclined position, and precisely so that the cover surface (10) lies horizontally in shape, as shown in FIG. 6. Both molding form halves (S—1 and S—2) are differently inclined and shown roughly cross-hatched in FIG. 6. For simplicity, the injecting channels are omitted in FIG. 6. In order to carry out such type of manufacture, the geometrical conditions as described in this specification are unavoidable.

Although the closure according to this invention is particularly advantageous for use in tubes, it is not limited to tubes. The aesthetic form of the closure is of decisive importance. The present invention gives an expert technician in the packaging industry additional freedom which can be fully utilized without increasing the cost of the closure.

Figure 7:
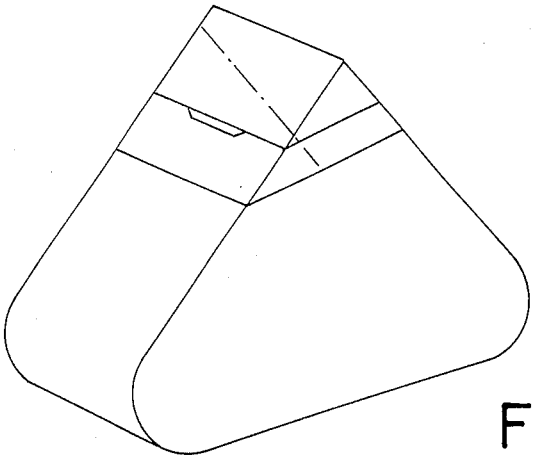
FIGS. 7 and 8 show two examples for the construction of containers having a closure in accordance with this invention.
Figure 8:
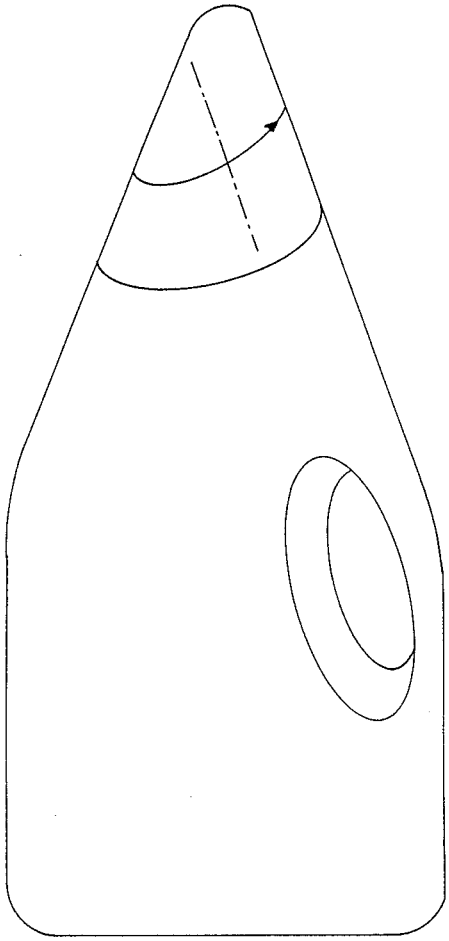

Although in the embodiment shown in detail the cover surface (10) is perpendicular to the wall part (11') in the area of the hinge (3), this is not a requirement. It is possible to place the cover surface (10) parallel to the base surface (6). FIGS. 7 and 8 only serve the purpose of illustrating how the closure is mounted on various containers. For illustration purposes, the axis of the discharge spout is shown by the dotted/dashed line.

I claim:

1. A one-part plastic closure having a hinge, for containers, in a closed position the closure comprising:

a lower part having a side wall and a sealing cover surface, said lower part having an overall shape of a truncated cone, said cover surface inclined with respect to an axis of said truncated cone, a discharge spout mounted through said cover surface, a cap hingedly connected with said lower part and sealing said discharge spout, said cap having a side wall part in which said hinge is positioned at an acute inward angle with respect to a base surface of said lower part and said discharge spout being mounted through said cover surface and parallel to said side wall part.

2. A one-part plastic closure in accordance with claim 1, wherein said side wall has a wall thickness that is tapered at a lower end.

3. A one-part plastic closure in accordance with claim 1, wherein a lower spout part of said discharge spout below said cover surface has a diameter smaller than an upper spout part of said discharge spout above said cover surface, said discharge spout has openings providing communication between said discharge spout and a space below said cover surface, and said openings are positioned in a transition area of said upper spout part and said lower spout part.

4. A one-part plastic closure in accordance with claimn 1, wherein the closure has a gripping recess for opening the closure.

5. A one-part plastic closure in accorance with claim 4, wherein said cap has a wall part on a side positioned toward said hinge which is parallel to said side wall part of said lower part in an area of said hinge.

* * * * *